US005915983A

United States Patent [19]

Ishikawa et al.

[11] Patent Number: 5,915,983

[45] Date of Patent: Jun. 29, 1999

[54] CONNECTION STRUCTURE

[75] Inventors: Satoshi Ishikawa; Takuji Kinoshita; Yasutaka Nagaoka, all of Shizuoka-ken, Japan

[73] Assignee: Yazaki Corporation, Tokyo, Japan

[21] Appl. No.: 08/755,745

[22] Filed: Nov. 22, 1996

[30] Foreign Application Priority Data

Nov. 24, 1995 [JP] Japan ..... 7-305789

[51] Int. Cl.[6] ..... H01R 3/00

[52] U.S. Cl. ..... 439/164; 439/15; 439/329

[58] Field of Search ..... 439/329, 366, 439/367, 373, 493, 15, 164, 67

[56] References Cited

U.S. PATENT DOCUMENTS

| | | | |
|---|---|---|---|
| 3,560,908 | 2/1971 | Dell et al. | 439/353 |
| 3,571,782 | 3/1971 | Colbert | 439/367 |
| 5,078,620 | 1/1992 | Verhoeven | 439/687 |
| 5,533,908 | 7/1996 | Henry et al. | 439/329 |
| 5,649,835 | 7/1997 | Weed | 439/373 |

FOREIGN PATENT DOCUMENTS 6-38051 10/1994 Japan .

*Primary Examiner*—Paula Bradley
*Assistant Examiner*—Katrina Davis
*Attorney, Agent, or Firm*—Finnegan, Henderson, Farabow, Garrett & Dunner, L.L.P.

[57] ABSTRACT

A connection structure for connecting a connection mold to a fixed member, wherein a connection member which is connected to the fixed member to surround the connection mold is provided, the fixed member and the connection mold are provided with first position restraining means arranged to be slid from a predetermined direction X so as to be engaged to the fixed member and the connection mold in order to prevent mutual movement between the fixed member and the connection mold, and the fixed member and the connection member are provided with second position restraining means arranged to be slid from direction Y perpendicular to the direction X so as to be engaged to the fixed member and the connection member in order to prevent mutual movement between the fixed member and the connection member in a state where the connection mold is surrounded.

14 Claims, 5 Drawing Sheets

CONNECTION STRUCTURE

BACKGROUND OF THE INVENTION

The present invention relates to a connection structure for connecting a member, such as a cable or a connector, to a predetermined member.

As a connection structure of the foregoing type, a structure disclosed in, for example, Japanese Utility Model Publication No. 6-38051 has been known, in which a cable is connected to a cable deducting portion. The connection structure has a fixed guide and a holder connected to the fixed guide so as to hold cables. The fixed guide and the holder are connected to each other by engaging an engaging groove formed in a snap connection member of the holder to an engaging projection provided for the fixed guide. That is, the snap connection member elastically deforms and surmounts the engaging projection so that the engaging groove is engaged to the engaging projection.

However, the above-mentioned conventional connection structure, having the arrangement such that the engaging groove is provided for the flexible snap connection member, which can be elastically deformed, and the engaging projection is engaged to the engaging groove so as to establish the connection encounters a problem of unsatisfactory connection strength.

SUMMARY OF THE INVENTION

In view of the foregoing, an object of the present invention is to provide a connection structure with which great connection strength can be obtained.

In order to achieve the foregoing object, according to the present invention, there is provided a connection structure for connecting a second member to a first member, comprising: a third member connected to the first member to surround the second member; first position restraining means arranged to be slid from a predetermined direction X so as to be engaged to the first and second members in order to inhibit mutual movement between the first member and the second member; and second position restraining means arranged to slide from direction Y perpendicular to the direction X so as to be engaged to the first and third members in order to inhibit mutual movement between the first member and the third member in a state where the second member is surrounded.

With the above-mentioned structure, simple sliding of the first and second members in the direction X causes a state where the first position restraining means to be engaged without elastic deformation to be realized. Therefore, the rigidity of the first position restraining means can be strengthened as desired in such a manner that the engagement of the first position restraining means can be performed as desired. Moreover, the depth of the portion in which the first position restraining means is engaged and the area of contact between the engaging portions can be enlarged as desired. Therefore, the connection strength between the first member and the second member in the direction perpendicular to the predetermined direction X can be satisfactorily increased.

Similarly, the rigidity of the second position restraining means, depth of engagement and the contact area between engaging portions can be enlarged as desired. Therefore, the connection strength between the first member and the third member in the direction perpendicular to the direction Y can satisfactorily be enlarged. As a result, the connection strength between the first member and the second member in the direction perpendicular to the direction Y can be satisfactorily increased.

Therefore, the connection strength between the first member and the second member can be increased in both of the direction perpendicular to the direction X and the direction perpendicular to the direction Y. That is, the connection strength between the first member and the second member can be satisfactorily increased in all directions.

The first position restraining means may have a recess provided for either of the first member or the second member and a projection provided for the first member or the second member, which is not provided with the recess, and arranged to slide from the direction X so as to be engaged to the recess.

As a result of the above-mentioned structure, simple sliding of the first and second members into the direction X causes a state in which the recess and the projection are engaged to each other without elastic deformation to be realized. Therefore, the rigidity of each of the recess and the projection, the depth of the engagement and the area of contact between the engaging portions can be enlarged in such a manner that the engagement between the recess and the projection can be performed as desired. Therefore, the connection strength between the first member and the second member in the direction perpendicular to the direction X can be satisfactorily increased.

The first position restraining means may have a slide projection provided for either of the first member or the second member and extending in the direction X and a slide groove provided for the first member or the second member, which is not provided with the projection, and arranged to slide from the direction X so as to engage the slide projection.

As a result of the above-mentioned structure, the rigidity of the slide projection and that of the slide groove, the depth of engagement and the area of contact between the engaging portions can be enlarged. Therefore, the connection strength between the first member and the second member in the direction perpendicular to the direction X can be satisfactorily increased. Moreover, the slide projection and the slide groove enable the first member and the second member to accurately and easily slide in the direction X.

The second position restraining means may have an outer thin portion provided for either of the first member or the third member and an inner thin portion provided for the first member or the third member, which is not provided with the outer thin portion, and arranged to slide in the direction Y so as to be engaged to the inside portion of the outer thin portion.

As a result of the above-mentioned structure, simple sliding of the first member and the third member in the direction Y causes the outer thin portion and the inner thin portion to be engaged to each other without elastic deformation. Therefore, the rigidity of the outer thin portion and that of the inner thin portion, the depth of the engagement and the area of contact between the engaging portions can be enlarged in such a manner that the engagement between the outer thin portion and the inner thin portion can be performed as desired. Thus, the connection strength of the first member and the third member in the direction perpendicular to the direction Y can be satisfactorily increased. As a result, the connection strength between the first member and the second member in the direction perpendicular to the direction Y can be satisfactorily increased.

The second position restraining means may have an engaging groove provided for either of the first member or the third member and an engaging projection provided for the first member or the third member, which is not provided with the engaging groove, and arranged to be slid from the direction Y so as to be engaged to the engaging groove.

As a result of the above-mentioned structure, the rigidity of the engaging groove and that of the engaging projection, the depth of the engagement and the area of contact between the engaging portions can be enlarged. Therefore, the connection strength between the first member and the third member in the direction perpendicular to the direction Y can be satisfactorily increased. Thus, the connection strength between the first member and the second member in the direction perpendicular to the direction Y can be satisfactorily increased.

The second position restraining means may have a slide groove provided for either of the first member or the third member and extending in the direction Y and a slide projection provided for the first member or the third member, which is not provided with the slide groove and arranged to slide from the direction Y so as to be engaged to the slide groove.

As a result of the above-mentioned structure, the rigidity of the slide groove and that of the slide projection, the depth of the engagement and the area of contact between the engaging portions can be enlarged. Therefore, the connection strength between the first member and the third member in the direction perpendicular to the direction Y can be satisfactorily increased. Thus, the connection strength between the first member and the second member in the direction perpendicular to the direction Y can be satisfactorily increased. Moreover, the slide groove and the slide projection enable the first member and the third member to accurately and easily slide in the direction Y.

The second position restraining means may have an arm wall provided for the third member and arranged to be slid from the direction Y so as to hold the first member.

As a result of the above-mentioned structure having the arm wall for holding the first member provided for the third member, the connection strength between the first member and the third member in the direction perpendicular to the direction Y can be satisfactorily increased. As a result, the connection strength between the first member and the second member in the direction perpendicular to the direction Y can be satisfactorily increased. Moreover, the arm wall enables the third member to accurately and easily slide along the first member in the direction Y.

The second position restraining means may have a slide groove which is formed in the first member and to which the arm wall is engaged.

As a result of the above-mentioned structure, the slide groove provided for the first member enables the arm wall to accurately and easily slide in the direction Y.

DESCRIPTION OF THE PREFERRED EMBODIMENTS

Figure 1:
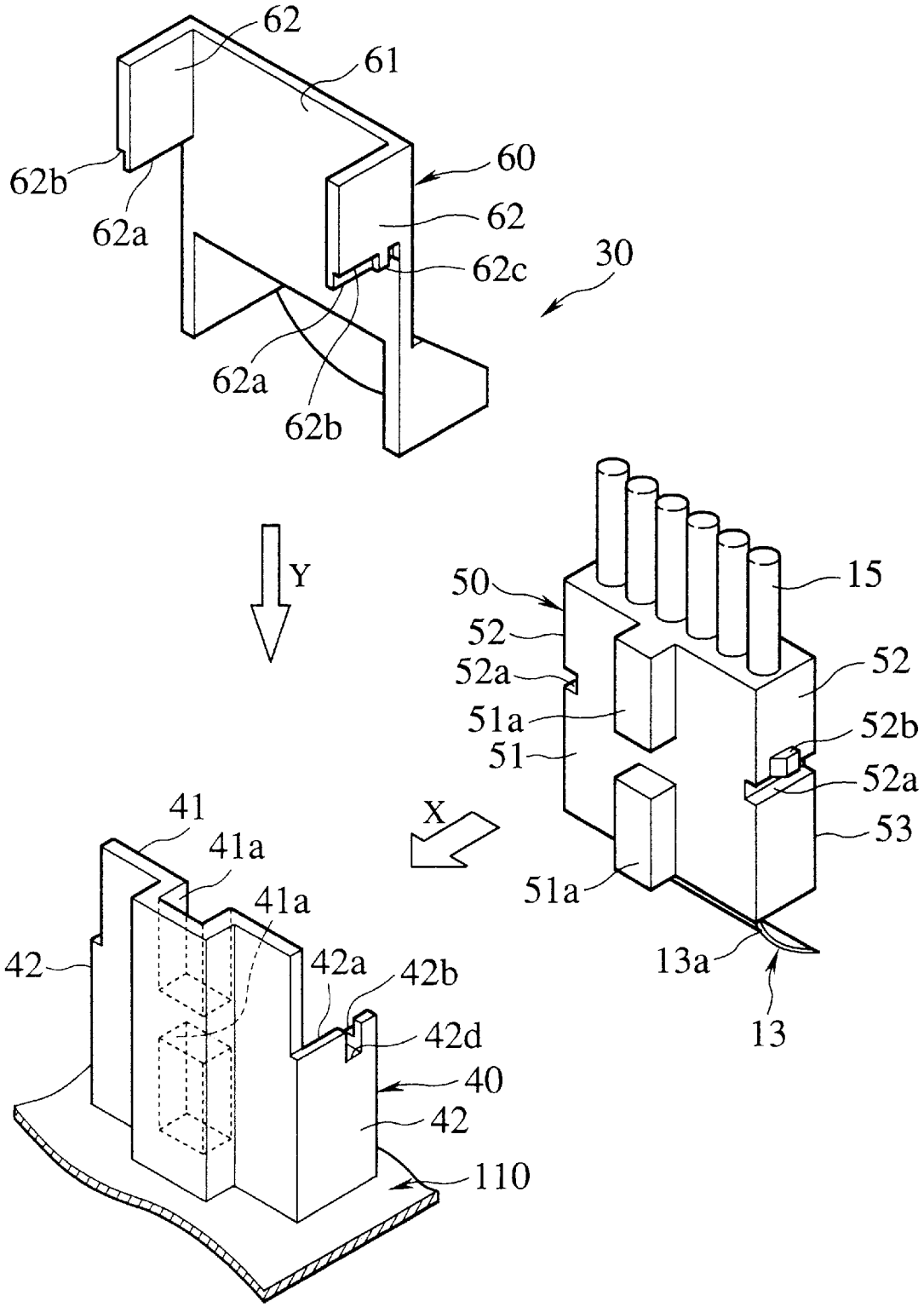
FIG. 1 is an exploded perspective view showing a connection structure according to a first embodiment of the present invention.
Figure 2:
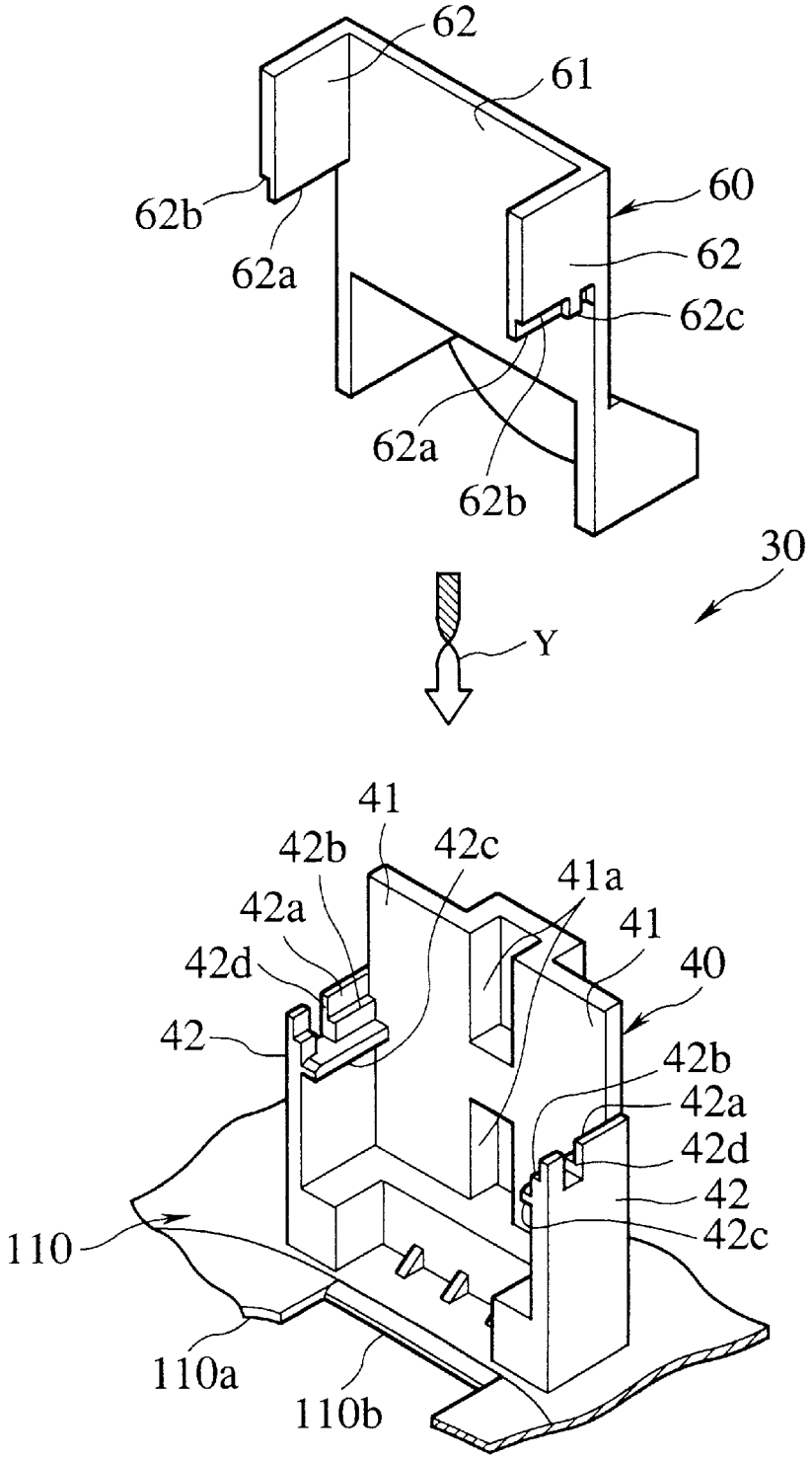
FIG. 2 is an exploded perspective view showing a fixed member and a connection member of the connection structure shown in FIG. 1.
Figure 4:
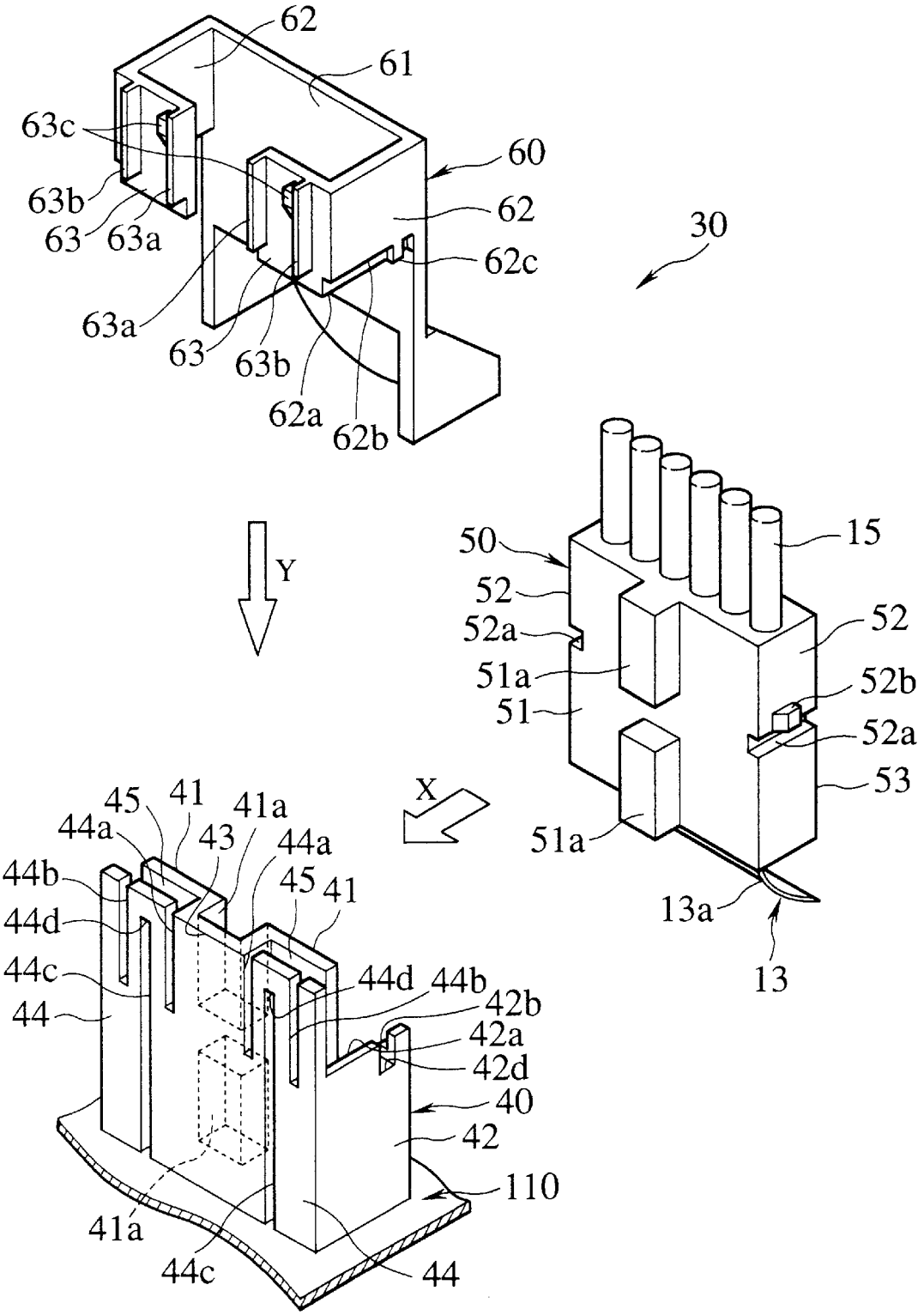
FIG. 4 is an exploded perspective view showing a connection structure according to a second embodiment of the present invention.
Figure 5:
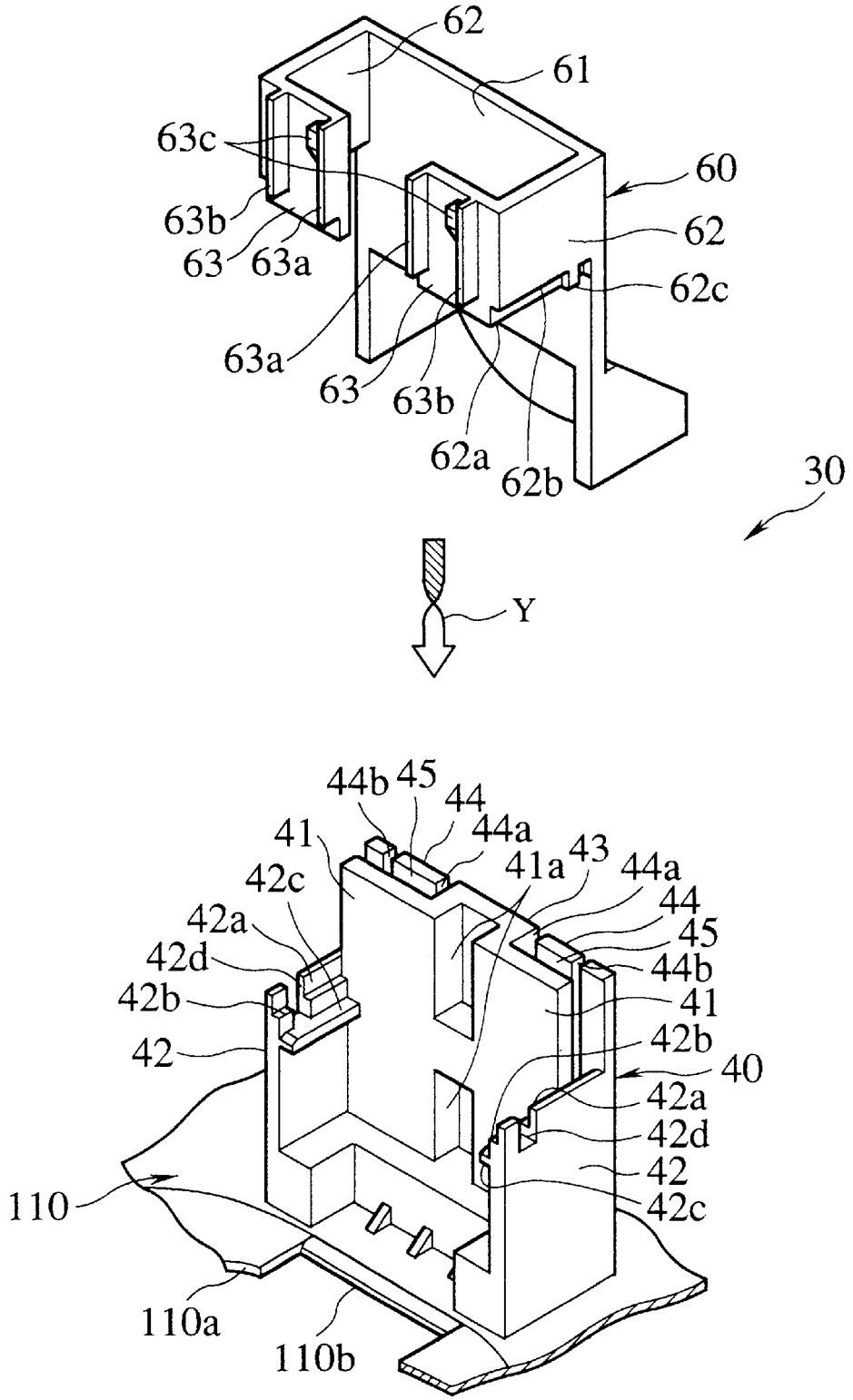
FIG. 5 is an exploded perspective view showing a fixed member and a connection member of the connection structure shown in FIG. 4.

Preferred embodiments of the present invention will now be described with reference to FIGS. 1 to 5. Note that FIGS. 1 to 3 show a first embodiment of the present invention, and FIGS. 4 and 5 show a second embodiment of the same.

Initially, a first embodiment of the present invention will now be described with reference to FIGS. 1 to 3. A connection structure 30 according to this embodiment is provided for a reel-type connection unit 10 shown in FIG. 3.

Figure 3:
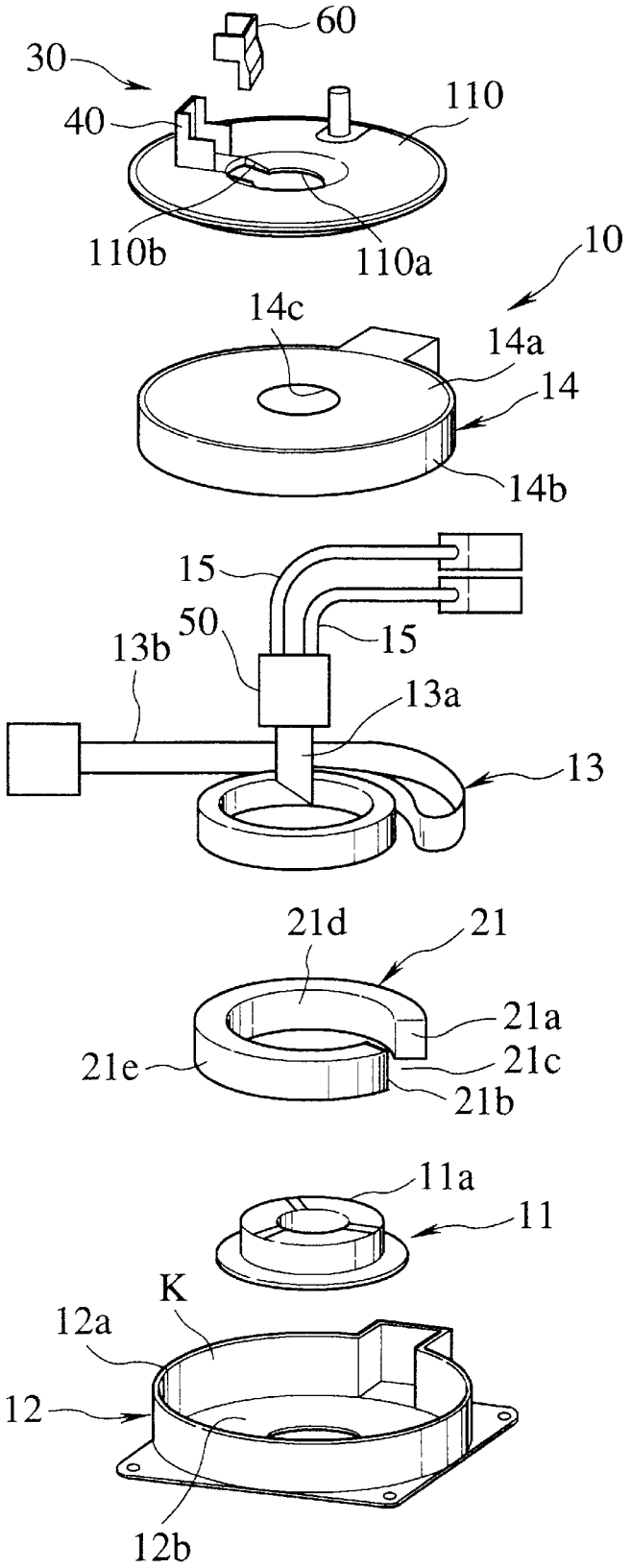
FIG. 3 is an exploded perspective view showing a reel connection apparatus having the connection structure shown in FIG. 1.

As shown in FIG. 3, the reel-type connection unit 10 has a rotary body 11, a fixed body 12, a flexible flat cable 13 and a movable member 21.

The rotary body 11 has an inner cylindrical member 11*a*, while the fixed body 12 has an outer cylindrical member 12*a* for surrounding the inner cylindrical member 11*a* at a predetermined distance. The flat cable 13 is accommodated in an annular space between the inner cylindrical member 11*a* and the outer cylindrical member 12*a* in such a manner that the flat cable 13 is placed along the annular space while being folded back at an intermediate position thereof to form a vortex shape. An inner end 13*a* and an outer end 13*b* of the flat cable 13 respectively are held by the inner cylindrical member 11*a* and the outer cylindrical member 12*a*. The movable member 21 is disposed movably along the annular space and formed into a C-shape having an opening 21*c* at which the flat cable 13 is folded back.

The fixed body 12 is provided with a cover member 14 for covering the upper portion of the annular space and the external periphery of the outer cylindrical member 12*a*. The cover member 14 comprises an upper cover member 14*a* for covering the upper portion of the annular space and a cylindrical member 14*b* for surrounding the outer cylindrical member 12*a*, the cover member 14 being attached to the fixed body 12 in such a manner that rotation of the cover member 14 with respect to the fixed body 12 is inhibited. In a central portion of the upper cover member 14*a*, there is formed an opening 14*c*. The fixed body 12 has a lower cover member 12*b* for covering the lower portion of the annular space, the lower cover member 12*b* being formed integrally with the outer cylindrical member 12*a*.

An external connection cover member 110 is rotatively provided on the cover member 14. The external connection cover member 110 is connected to the inner cylindrical member 11*a* through the opening 14*c* of the cover member 14 so as to hold the connection portion between the inner end 13*a* of the flat cable 13 and the cables 15.

The rotary body 11 is connected to, for example, a steering wheel portion (a steering shaft) of an automobile, while the fixed body 12 is connected to a steering column of the same.

In the reel-type connection unit 10 having the above-mentioned structure and capable of establishing the connection between members which are rotated mutually, counter-clockwise rotation of the inner cylindrical member 11*a* when viewed in FIG. 3 causes the flat cable 13 to be moved in such a manner that the flat cable 13 is wound around the inner cylindrical member 11*a*. Therefore, a portion of the flat cable 13 positioned on the outside of the movable member 21 is brought into contact with an outer surface 21*e* of the movable member 21, and then folded back while being brought into contact with the opening end 21*a*. As a result, the flat cable 13 is introduced into the inside portion of the movable member 21 so that the flat cable 13 is wound around the inner cylindrical member 11*a*. At this time, the opening end 21*a* of the movable member 21 is pushed by the flat cable 13 so that the movable member 21 is rotated counterclockwise.

When the inner cylindrical member 11*a* is rotated clockwise when viewed in FIG. 3, the flat cable 13 wound around the inner cylindrical member 11*a* is rewound so that the flat cable 13 is moved to the surrounding portions. As a result, the flat cable 13 wound around the inner cylindrical member 11*a* is brought into contact with the inner surface of the movable member 21, and then folded back while being brought into contact with the other opening end 21*b*. Thus, the flat cable 13 is moved to the outside of the movable member 21, and then brought into contact with the inner surface of the outer cylindrical member 12*a*. At this time, the opening end 21*b* is pushed by the flat cable 13 so that the movable member 21 is rotated clockwise.

As shown in FIGS. 1 and 2, the connection structure 30 has a fixed member (a first member) 40, a connection mold (a second member) 50 and a connection member (a third member) 60.

The fixed member 40 is molded integrally with the external connection cover member 110 by resin and comprises a front wall 41 extending from the upper surface of the external connection cover member 110 and side walls 42 disposed on the right and left sides of the front wall 41. The front wall 41 is formed along a guide groove 110*b* (see FIG. 2) of the external connection cover member 110, the front wall 41 having, in the central portion thereof, recesses 41*a* formed apart from each other in the vertical direction. Each of the side walls 42 are formed lower than the front wall 41 and have an outer thin portion 42*a* having a small thickness and formed by reducing the inner portion thereof. A portion below the outer thin portion 42*a* has a regular thickness through a stepped portion 42*b*. A slide projection 42*c* extending straight along the stepped portion 42*b* is formed below the stepped portion 42*b*. The slide projection 42*c* extends in a direction perpendicular to the front wall 41, that is, in the direction X. Moreover, each of the side walls 42 has an engaging groove 42*d* formed from the top end thereof to the slide projection 42*c*.

The connection mold 50 is formed by sealing the overall connection portion between the flat cable 13 and the other cables 15 with resin so as to secure the cables 13 and 15. The connection mold 50 is formed into a quadrilateral so as to be accommodated in a space surrounded by the front wall 41 and the side walls 42. A front surface 51 opposite to the front wall 41 has projections 51*a* which respectively are engaged to the recesses 41*a*. That is, when the front surface 51 is slid to approach the front wall 41, each of the projections 51*a* is engaged to each recesses 41*a*. The recesses 41*a* and projections 51*a* form a first position restraining means for inhibiting the mutual movement between the fixed member 40 and the connection mold 50.

The side surface 52 opposite to each of the side walls 42 has a slide groove 52*a* arranged to be engaged to the slide projection 42*c* of the fixed member 40. An engaging projection 52*b* which is received by the engaging groove 42*d* when a portion including the engaging groove 42*d* of the side walls 42 is elastically deformed is formed above the slide groove 52*a*. The engaging projection 52*b* is arranged to be engaged to the lower portion of the engaging groove 42*d*, that is, the stepped portion 42*b*. Also the slide projection 42*c* and slide groove 52*a* form the first position restraining means for inhibiting the mutual movement between the fixed member 40 and the connection mold 50.

When the connection member 60 is slid from direction Y perpendicular to the direction X in a state where the connection mold 50 has been inserted into the fixed member 40, the connection member 60 is secured to the fixed member 40 to surround the connection mold 50. The connection member 60 has an outer wall 61 opposite to a reverse surface of the connection mold 50 and side walls 62 connected to the upper portion of each of the side walls 42 of the fixed member 40. An inner thin portion 62*a* is formed in the lower end portion of each of the side walls 62, the inner thin portion 62*a* being formed by thinly retaining the inside portion so as to be engaged to the inside portion of the outer thin portion 42*a*. The portion above the inner thin portion 62*a* has a regular thickness through a stepped portion 62*b*. The inner thin portion 62*a* has an engaging projection 62*c* arranged to be engaged to the engaging groove 42*d* formed in the outer thin portion 42*a* of the fixed member 40. The connection member 60 formed as described above is integrally molded by resin. The outer thin portion 42*a*, the inner thin portion 62*a*, the engaging groove 42*d* and the engaging projection 62*c* form a second position restraining means arranged to be engaged without elastic deformation when the connection member 60 slides in the direction Y toward the fixed member 40 so as to inhibit mutual movement between the fixed member 40 and the connection member 60 in a direction perpendicular to the direction Y.

In the connection structure 30 having the above-mentioned structure, the connection mold 50 slides into the fixed member 40 from the direction X while causing the slide groove 52*a* engages to the slide projection 42*c* of the fixed member 40. As a result, each of the projections 51*a* of the connection mold 50 is engaged to each of the recesses 41*a* of the fixed member 40 without elastic deformation. Moreover, the engaging projection 52*b* elastically deforms the portion around the engaging groove 42*d*, and then the engaging projection 52*b* engages the engaging groove 42*d*. As a result of the engagement between each of the recesses 41*a* and each of the projections 51*a* and the engagement between the slide projection 42*c* and the slide groove 52*a*, the connection mold 50 is secured to the fixed member 40 in a direction perpendicular to the direction X. The engaging groove 42*d* and the engaging projection 52*b* engaged due to the elastic deformation causes the connection member 60 to be secured to the fixed member 40 also in the direction X.

Then, the connection member 60 slides in the direction Y onto the fixed member 40 so that the connection member 60 is secured to the fixed member 40. At this time, the inner thin portion 62*a* of the connection member 60 is engaged to the inside portion of the outer thin portion 42*a* of the fixed member 40. Moreover, the engaging projection 62*c* is engaged to the upper portion of the engaging projection 52*b*. When the foregoing engagements are performed, the inner thin portion 62*a*, the outer thin portion 42*a*, engaging projection 62*c* and the engaging groove 42*d* are free from elastic deformation. The engagement between the inner thin portion 62*a* and the outer thin portion 42*a* and that between the engaging projection 62*c* and the engaging groove 42*d* causes the connection member 60 to be secured to the fixed member 40 in a direction perpendicular to the direction Y. As a result, the connection mold 50 is secured to the fixed member 40 in a direction perpendicular to the direction Y.

The connection structure 30 having the above-mentioned structure enables the recesses 41*a* and the projections 51*a* to be engaged without elastic deformation by simply causing the connection mold 50 to approach the fixed member 40 in the direction X. Therefore, the rigidity of the portion around the recesses 41*a* and that of the projections 51*a* can be strengthened as desired. Moreover, the depth of the portion in which the recesses 41*a* and the front surface 51 are engaged to each other and the area of contact between the same can be enlarged as desired. Similarly, the rigidity of the slide projection 42*c* and that of the slide groove 52*a* can be strengthened as desired. Moreover, the depth of the portion in which the slide projection 42*c* and the slide groove 52*a* are engaged to each other and the area of contact between the same can be enlarged as desired. Therefore, the strength of the connection between the fixed member 40 and the connection mold 50 in the direction perpendicular to the direction X can be satisfactorily increased.

Since the outer thin portion 42*a* and the inner thin portion 62*a* can be engaged without elastic deformation by simply sliding the connection member 60 onto the fixed member 40 in the direction Y perpendicular to the direction X, the rigidity of the outer thin portion 42*a* and that of the inner thin portion 62*a* can be strengthened as desired. Moreover, the depth of the portion in which the outer thin portion 42*a* and the inner thin portion 62*a* are engaged to each other and the area of contact between the same can be enlarged as desired. Similarly, the rigidity of the engaging groove 42*d* and that of the engaging projection 62*c* can be strengthened as desired. Moreover, the depth of the portion in which the engaging groove 42*d* and the engaging projection 62*c* and the area of contact between the same can be enlarged as desired. As a result, the strength of the connection between the fixed member 40 and the connection member 60 in the direction perpendicular to the direction Y can be satisfactorily increased. Thus, the strength of the connection between the fixed member 40 and the connection mold 50 in the direction perpendicular to the direction Y can be satisfactorily increased.

Therefore, the strength between the fixed member 40 and the connection mold 50 can be increased in both of the direction perpendicular to the direction X and the direction perpendicular to the direction Y. That is, the strength of the connection between the fixed member 40 and the connection mold 50 can be satisfactorily increased in all directions.

The second embodiment of the present invention will now be described with reference to FIGS. 4 and 5. Element common to those according to the first embodiment shown in FIGS. 1 to 3 are given the same reference numerals and the common elements are omitted from description. In the second embodiment, a portion of the fixed member 40 and that of the connection member 60 are different from those according to the first embodiment.

As shown in FIGS. 4 and 5, the fixed member 40 has reverse-side walls 44 formed from the two sides of the wall portion 44 forming the recesses 41*a* to run parallel to the front wall 41. Each of the reverse-side walls 44 is connected to each of the side walls 42 formed on the two sides of the front wall 41. A gap between the front wall 41 and the reverse-side walls 44 is formed into an arm slide groove 45 into which arm walls 63, to be described later, are received. Each of the reverse-side walls 44 has two slide grooves 44*a* and 44*b* formed downwards from the top end thereof and each having a predetermined length. The slide groove 44*a* is formed in the boundary between the wall portion 44 and the reverse-side walls 44. Each of the reverse-side walls 44 has an engaging groove 44*c* formed between the slide grooves 44*a* and 44*b* and formed from the bottom end to a position adjacent to the top end thereof. The engaging groove 44*c* has a top end which is formed into an engaging end 44*d*.

The connection member 60 has arm walls 63 respectively formed from the side walls 62 to run parallel to the outer wall 61. Each of the arm walls 63 is slid and introduced into the arm slide groove 45 formed by the front wall 41 and the reverse-side walls 44 from the direction Y so as to hold the front wall 41 in order to establish the connection with the fixed member 40. The arm walls 63 have slide projections 63*a* and 63*b* arranged to be slidably engaged to the respective slide grooves 44*a* and 44*b* of the reverse-side walls 44. Moreover, the arm walls 63 has an engaging projection 63*c* which elastically deforms the portion around the engaging end 44*d* of the reverse-side walls 44 so as to be engaged to the engaging end 44*d*.

The arm walls 63, the front wall 41, the arm walls 63, the arm slide groove 45, the slide grooves 44*a* and 44*b* and the slide projections 63*a* and 63*b* form a second position restraining means for inhibiting the mutual movement between the fixed member 40 and the connection member 60 in a direction perpendicular to the direction Y such that the connection member 60 and the fixed member 40 are as it is engaged without elastic deformation when the connection member 60 is slid in the direction Y toward the fixed member 40.

In the connection structure 30 structured as described above, the connection mold 50 is secured to the fixed member 40, and then the connection member 60 is slid toward the fixed member 40 from the direction Y so that the connection member 60 is connected to the fixed member 40. At this time, the arm walls 63 is introduced into the arm slide groove 45 without elastic deformation. Moreover, each of the slide projections 63*a* and 63*b* slide into each of the slide grooves 44*a* and 44*b* of the reverse-side walls 44. At this time, the engaging projection 63*c* elastically deforms the portion of the engaging end 44*d* of the reverse-side walls 44, and then the engaging projection 63*c* engages to the engaging end 44*d*. In addition, the inner thin portion 62*a* of the connection member 60 is engaged to the inside portion of the outer thin portion 42*a* of the fixed member 40. Moreover, the engaging projection 62*c* is engaged to the engaging groove 42*d*. As a result, the connection member 60 is secured to the fixed member 40 to surround the connection mold 50.

In the connection structure 30 structured as described above, the fixed member 40 and the connection member 60 are connected to each other via the slide connection between the front wall 41 and the arm walls 63. Therefore, the depth of the portion in which the slide connection is established and the area of contact between the can be enlarged as desired. Since the slide grooves 44*a* and 44*b* and the slide projections 63*a* and 63*b* can be engaged to each other without elastic deformation, the rigidity of each of the slide grooves 44*a* and 44*b* and each of the slide projections 63*a* and 63*b* can be strengthened as desired. Moreover, the depth of the portion in which the slide grooves 44*a* and 44*b* and the slide projections 63*a* and 63*b* are engaged to each other and the area of contact between the can be enlarged as desired. Therefore, the strength of the connection between the fixed member 40 and the connection member 60 in the direction perpendicular to the direction Y can be satisfactorily increased. As a result, the strength of the connection between the fixed member 40 and the connection mold 50 in the direction perpendicular to the direction Y can be satisfactorily increased.

Therefore, in both the direction perpendicular to the direction X and the direction perpendicular to the direction Y, the strength of the connection between the fixed member 40 and the connection mold 50 can be increased. That is, the strength of the connection between the fixed member 40 and the connection mold 50 can be strengthened in all directions.

Although the first and second embodiments are structured such that the recesses 41*a* is provided for the fixed member

40 and the projections 51*a* is provided for the connection mold 50, another structure may be employed in which the projection is provided for the fixed member 40 and the recess is provided for the connection mold 50. Moreover, the slide projection 42*c* and slide groove 52*a* may be provided for each of the fixed member 40 or the connection mold 50. The outer thin portion 42*a,* inner thin portion 62*a,* engaging groove 42*d,* engaging projection 62*c,* slide grooves 44*a* and 44*b* and the slide projections 63*a* and 63*b* may be provided for either of the fixed member 40 or the connection member 60.

What is claimed is:

1. A connection structure, comprising:

a first member having a front wall and opposing first side walls extending from the front wall;

a second member engagable within the first member, the second member having a front surface for abutting the front wall, a reverse surface parallel to the front surface, and opposing side surfaces for contacting the opposing first side walls of the first member, the opposing side surfaces extending from the front surface to the reverse surface; and a connection member having an outer wall for contacting the reverse surface, and connection side walls extending from the outer wall for contacting the side surfaces and for engaging the first side walls.

2. A connection structure according to claim 1, further comprising at least one recess on the front wall, and at least one corresponding projection on the front surface for engaging the recess when the second member engages the first member.

3. A connection structure according to claim 1, further comprising at least one recess on the front surface, and at least one corresponding projection on the front wall for engaging the recess when the second member engages the first member.

4. A connection structure according to claim 1, further comprising slide grooves in the first side walls, and corresponding slide projections on the side surfaces for engaging the slide grooves when the second member engages the first member.

5. A connection structure according to claim 1, further comprising slide grooves in the side surfaces, and corresponding slide projections on the first side wall for engaging the slide grooves when the second member engages the first member.

6. A connection structure according to claim 1, wherein the first side walls have outer thin portions and the connection side walls have inner thin portions, the outer thin portions overlap with the inner thin portions when the connection member engages the first member.

7. A connection structure according to claim 1, wherein the first side walls have inner thin portions and the connection side walls have outer thin portions, the outer thin portions overlap with the inner thin portions when the connection member engages the first member.

8. A connection structure according to claim 1, wherein the first side walls have engaging grooves and the connection side walls have engaging projections for engaging the engaging grooves when the connection member engages the first member.

9. A connection structure according to claim 1, wherein the first side walls have engaging projections and the connection side walls have engaging grooves for engaging the engaging projections when the connection member engages the first member.

10. A connection structure according to claim 1, further comprising slide grooves in the first member, and slide projections extending from the connection member for engaging the slide grooves when the connection member engages the first member.

11. A connection structure according to claim 1, further comprising slide grooves in the connection member, and slide projections extending from the first member for engaging the slide grooves when the connection member engages the first member.

12. A connection structure according to claim 1, further comprising arm walls extending from the connection sides walls for engaging the first member.

13. A connection structure according to claim 11, further comprising slide grooves in the front wall for engaging the arm walls when the connection member engages the first member.

14. A reel-type connection unit, comprising:

a fixed body;

a flexible flat cable in the fixed body, the cable having an end portion drawn out from the fixed body;

a first member on the fixed body, the first member having a front wall extending from the fixed body and opposing first side walls extending from the front wall;

a second member at the end portion of the cable, the second member engagable within the first member, the second member having a front surface for abutting the front wall, a reverse surface parallel to the front surface, and opposing side surfaces for contacting the opposing side walls, the opposing side surfaces extending from the front surface to the reverse surface; and a connection member having an outer wall for contacting the reverse surface, and connection side walls extending from the outer wall for contacting the side surfaces and for engaging the first side walls.

* * * * *